US006969296B1

(12) United States Patent
Chen

(10) Patent No.: US 6,969,296 B1
(45) Date of Patent: Nov. 29, 2005

(54) TOP WITH A LIGHTING DEVICE

(76) Inventor: Yi Ta Chen, 6F, No. 12, Lane 55, Sec. 4, Minsheng E. Rd., Songshan District, Taipei City 105 (TW)

( * ) Notice: Subject to any disclaimer, the term of this patent is extended or adjusted under 35 U.S.C. 154(b) by 78 days.

(21) Appl. No.: 11/040,028

(22) Filed: Jan. 24, 2005

(51) Int. Cl.[7] ..... A63H 1/24; A63H 1/28
(52) U.S. Cl. ..... 446/242; 446/256; 446/264; 446/484
(58) Field of Search ..... 446/175, 236, 446/242–244, 256, 258, 264, 233, 235, 484, 446/485

(56) References Cited

U.S. PATENT DOCUMENTS 1,856,514 A * 5/1932 Sheneman ..... 446/259
2,623,327 A * 12/1952 Testino ..... 446/242
3,191,344 A * 6/1965 Yagjian ..... 446/242
3,803,757 A * 4/1974 Sanchez ..... 446/242
4,552,542 A * 11/1985 Reysman ..... 446/254
5,683,284 A * 11/1997 Christen ..... 446/233
6,083,076 A * 7/2000 Saint-Victor ..... 446/242
6,666,743 B2 * 12/2003 Polare et al. ..... 446/256

* cited by examiner

*Primary Examiner*—Bena Miller
(74) *Attorney, Agent, or Firm*—Rosenberg, Klein & Lee

(57) ABSTRACT

A top includes a hollow body, a lighting received disposed in the hollow body, a conductor moved received in the hollow body and a cover mounted to a top of the hollow body for closing the hollow body. The conductor is moved to operate the lighting device due to a centrifugal force of rotating top.

9 Claims, 7 Drawing Sheets

TOP WITH A LIGHTING DEVICE

BACKGROUND OF THE INVENTION

1. Field of the Invention

The present invention relates to a top, and more particularly to a top with a lighting device.

2. Description of Related Art

A conventional top in accordance with the prior art only has a monotone type. Some top manufacturer changes the weight of the conventional top for an adult to train his/her arms or for a child to easily operating the top. For an amusing effect, some conventional tops provide whistle effect when being rotated.

However, all the conventional tops provide no lighting effect such that the conventional top needs to be advantageously altered.

The present invention has arisen to mitigate and/or obviate the disadvantages of the conventional tops.

SUMMARY OF THE INVENTION

The main objective of the present invention is to provide an improved top that includes a lighting device disposed therein for promoting an amusing effect of the top.

To achieve the objective, the top in accordance with the present invention comprises a hollow body, a lighting received disposed in the hollow body, a conductor moved received in the hollow body and a cover mounted to a top of the hollow body for closing the hollow body. The conductor is moved to operate the lighting device due to a centrifugal force of rotating top.

Further benefits and advantages of the present invention will become apparent after a careful reading of the detailed description with appropriate reference to the accompanying drawings.

DETAILED DESCRIPTION OF THE INVENTION

Figure 1:
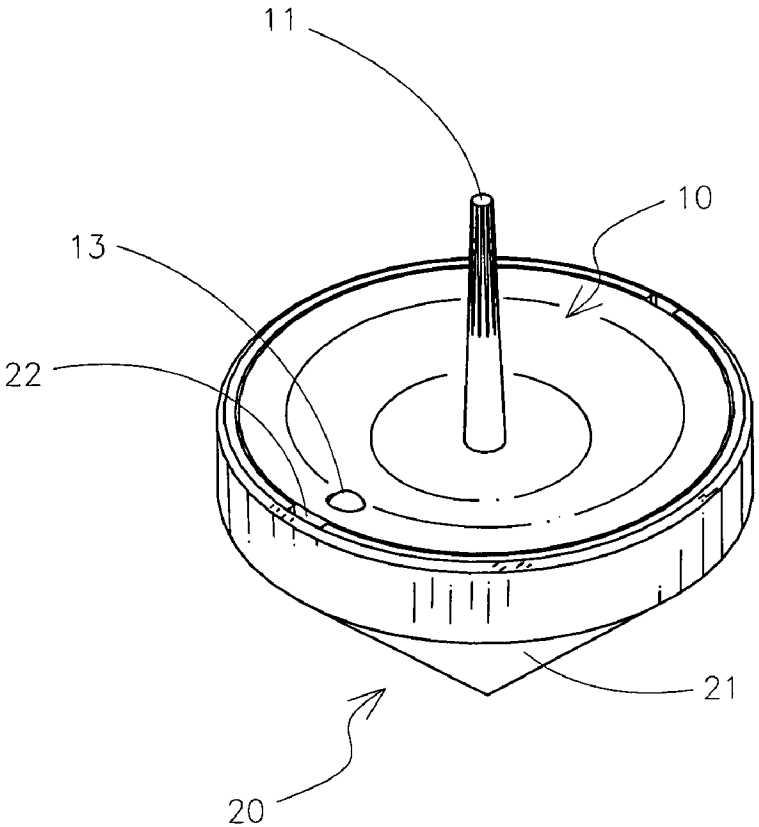
FIG. 1 is a perspective view of a top with a lighting device in accordance with the present invention.
Figure 2:
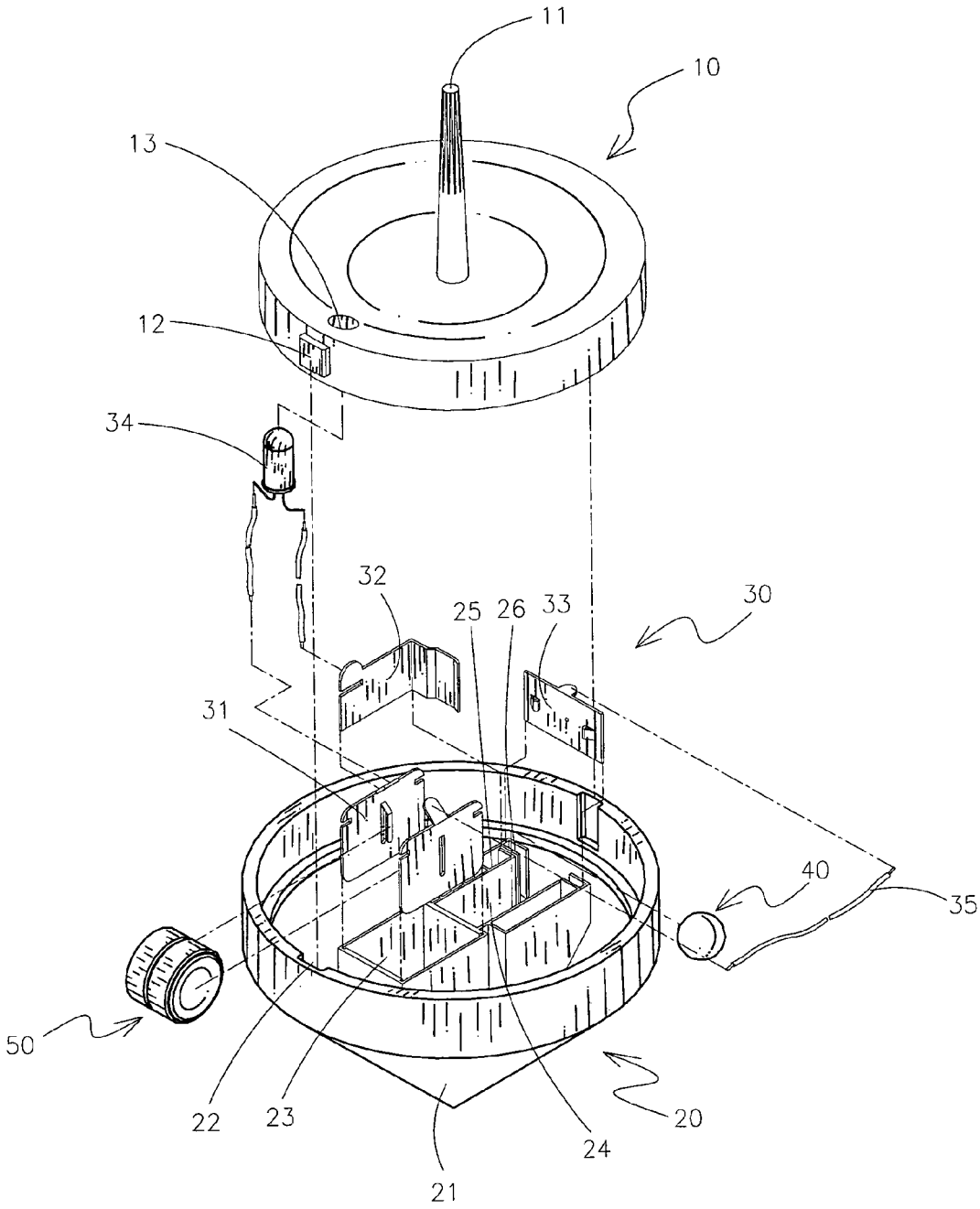
FIG. 2 is an exploded perspective view of the top in FIG. 1.
Figure 3:
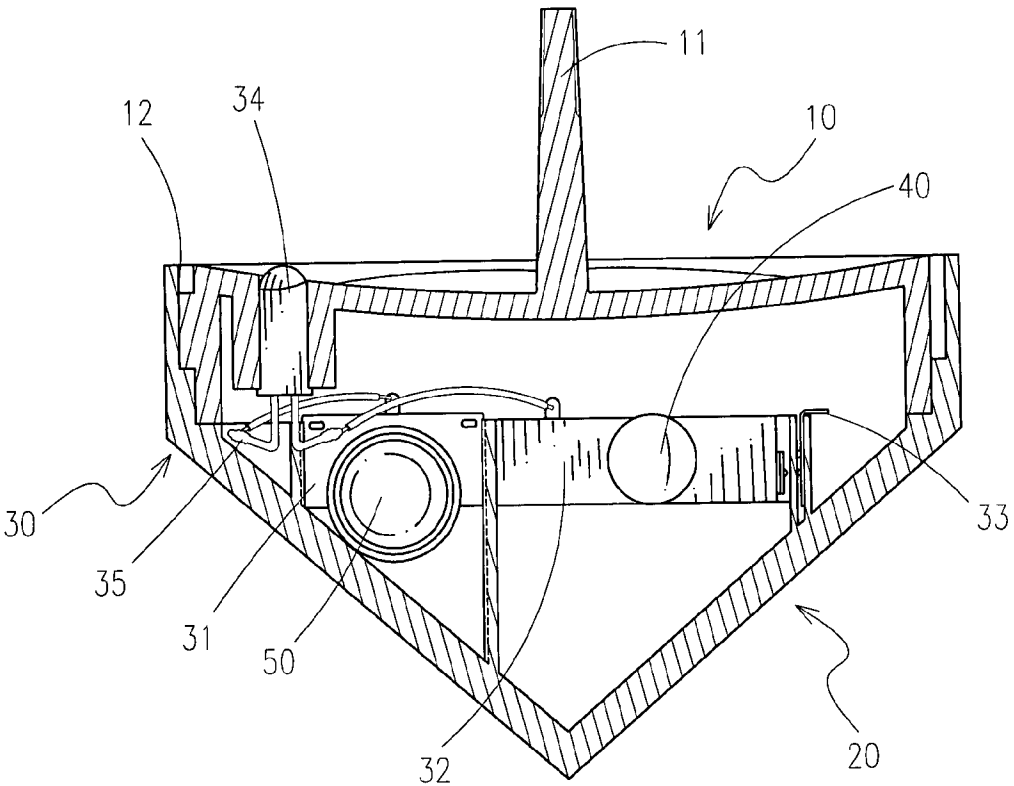
FIG. 3 is a cross-sectional view of the top in FIG. 1.

Referring to the drawings and initially to FIGS. 1–3, a top with a lighting device in accordance with the present invention comprises a hollow body (20) and a cover (10) detachably mounted to a top of the hollow body (20) for closing the hollow body (20). The cover (10) has a grip (11) centrally upwardly extending from the cover (10) for user to operate the top. The cover (10) includes multiple buckles (12) laterally extending from a periphery thereof and a transparent portion (13) formed thereon.

The hollow body (20) has a tapered portion (21) formed on a lower portion thereof and multiple slots (22) defined in an inner periphery of the hollow body (20). Each slot (22) detachably receives a corresponding one of the multiple buckles (12) of the cover (10) such that the cover (10) can be selectively detached from the hollow body (20). A first trough (23) and second trough (24) are respectively disposed in the hollow body (20). The first trough (23) and the second trough (24) are adjacent to each other. A passage (25) is disposed in the hollow body (20) and adjacent to one side of the second trough (24). A pair of guiding slots (26) is disposed on one end of the second trough (24) opposite to the first trough (23). The first trough (23), the passage (25) and the pair of slots (26) are provided for mounting the lighting device (30), and the second trough (24) is provided for receiving a steel ball that is used as a conductor (40) of the present invention.

The lighting device (30) includes two first conducting plates (31) respectively secured on two opposite walls of the first trough (23) for clamping a battery that provides the electric power to the top of the present invention. An L-shaped second conducting plate (32) is mounted in the hollow body (20) and has one end received in the passage (25). A third conducting plate (33) has two opposite sides respectively received in the pair of slots (26). A lighting element (34) is mounted in the hollow body (20) and aligns with the transparent portion (13) of the cover (10). Two wires (35) respectively electrically connected to two electrodes of the lighting element (34). One of the two wires (35) is electrically connected to one of the two first conducting plates (31) and the other is electrically connected to a free end of the second conducting plate (32). In addition, the other first conducting plate (31) is electrically connected to the third conducting plate (33). The second conducting plate (32) and the third conducting plate (33) separately overlapped with each other. In addition, the first conducting plate (31), the second conducting plate (32) and the third conducting (33) respectively in the first trough (23), the passage (25) and the guiding slots (26) are separated to one another. Each first conducting plate (31) has boss formed thereon for providing a stable connection between the two first conducting plates (31) and the battery (50).

Figure 4:
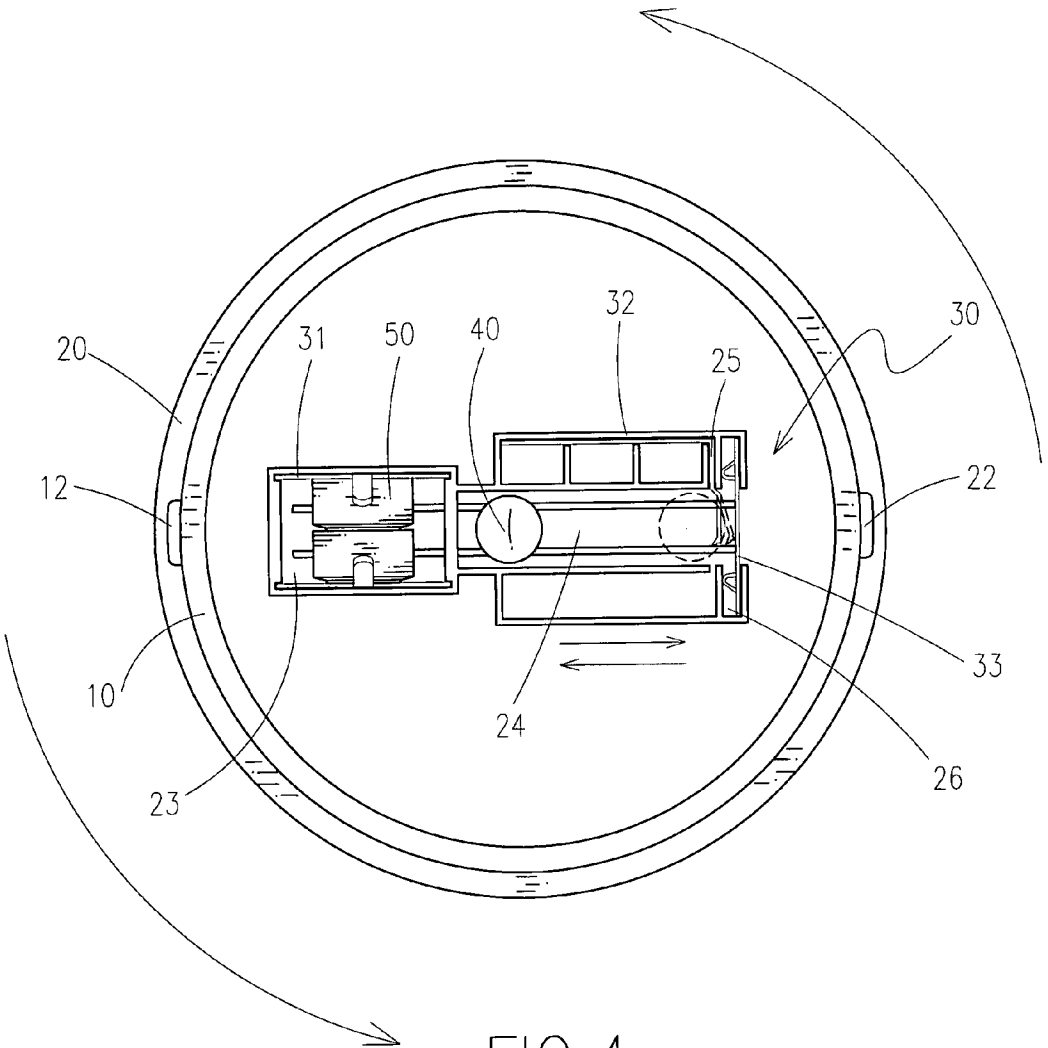
FIG. 4 is a top operational view of the top in FIG. 1.

With reference to FIG. 4, when operating the top in accordance with the present invention, the conductor (40) is moved toward the periphery of the hollow body (20) along the second trough (24) due to a centrifugal force of the rotating top when the top of the present invention is rotated. As a result, the conductor (40) compresses the free end of the second conducting plate (32) to contract with the third conducting plate (33) to form an electric conduction. Then, the electric current from the battery (50) sequentially flows through one of the first conducting plate (31), the third conducting plate (33), the second conducting plate (32), the lighting element (34) and the other first conducting plate (31) to form a closed circuit to make the lighting element (34) light. Consequently, the transparent portion (13) of the cover (10) forms a ring of light ray for promoting a lighting effect of the top of in accordance with the present invention when the top is rotated.

Further more, the buckles (12) of the cover (10) and the slots (22) in the hollow body (20) can be exchanged and the cover (10) equally can be mounted on the top of the hollow body (20).

Figure 5:
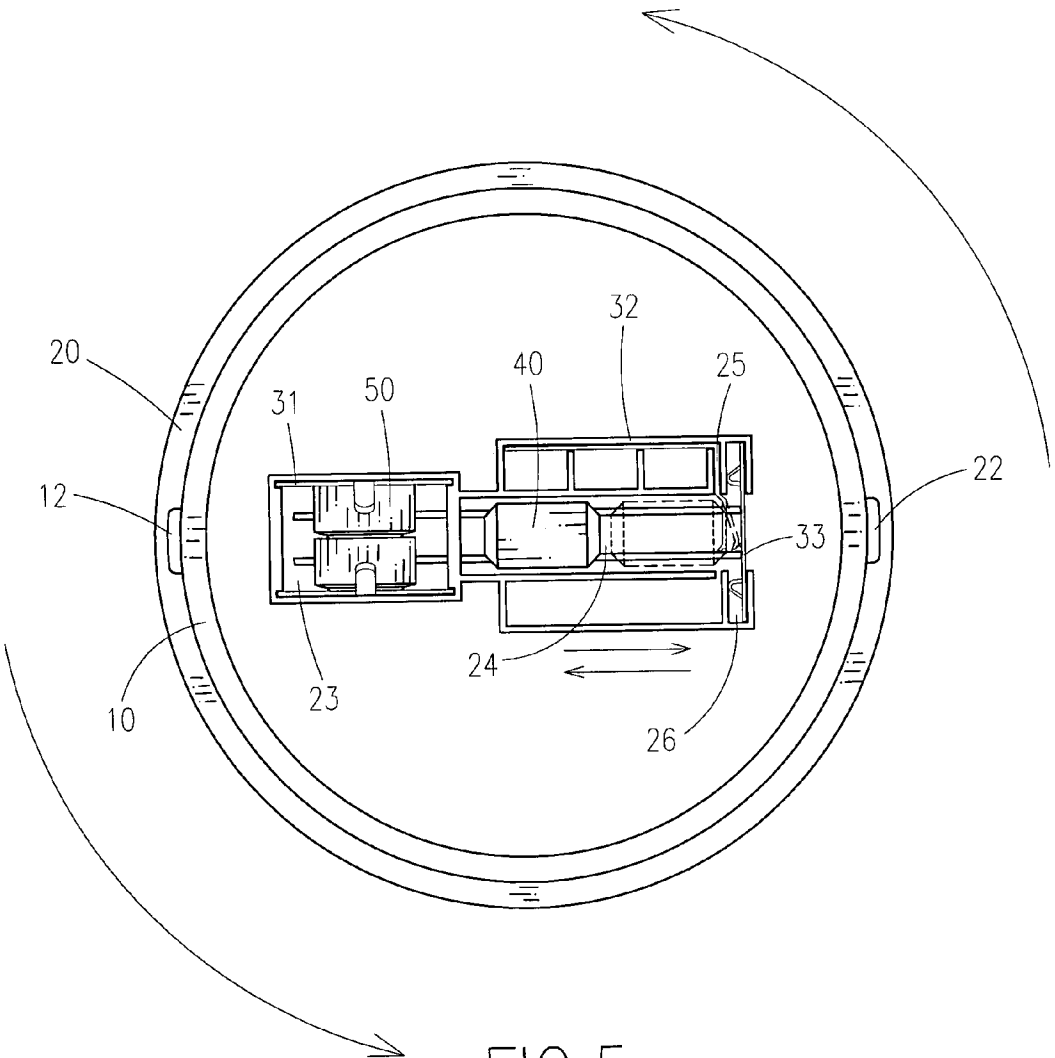
FIG. 5 is a top operational view of a second embodiment of the top in accordance with the present invention.

With reference to FIG. 5, the conductor (40) of the present invention may be designed to a metal cylinder or nonmetal element because the conductor only provides to compress the second conducting plate (32) to abut the third conducting plate (33).

Figure 6:
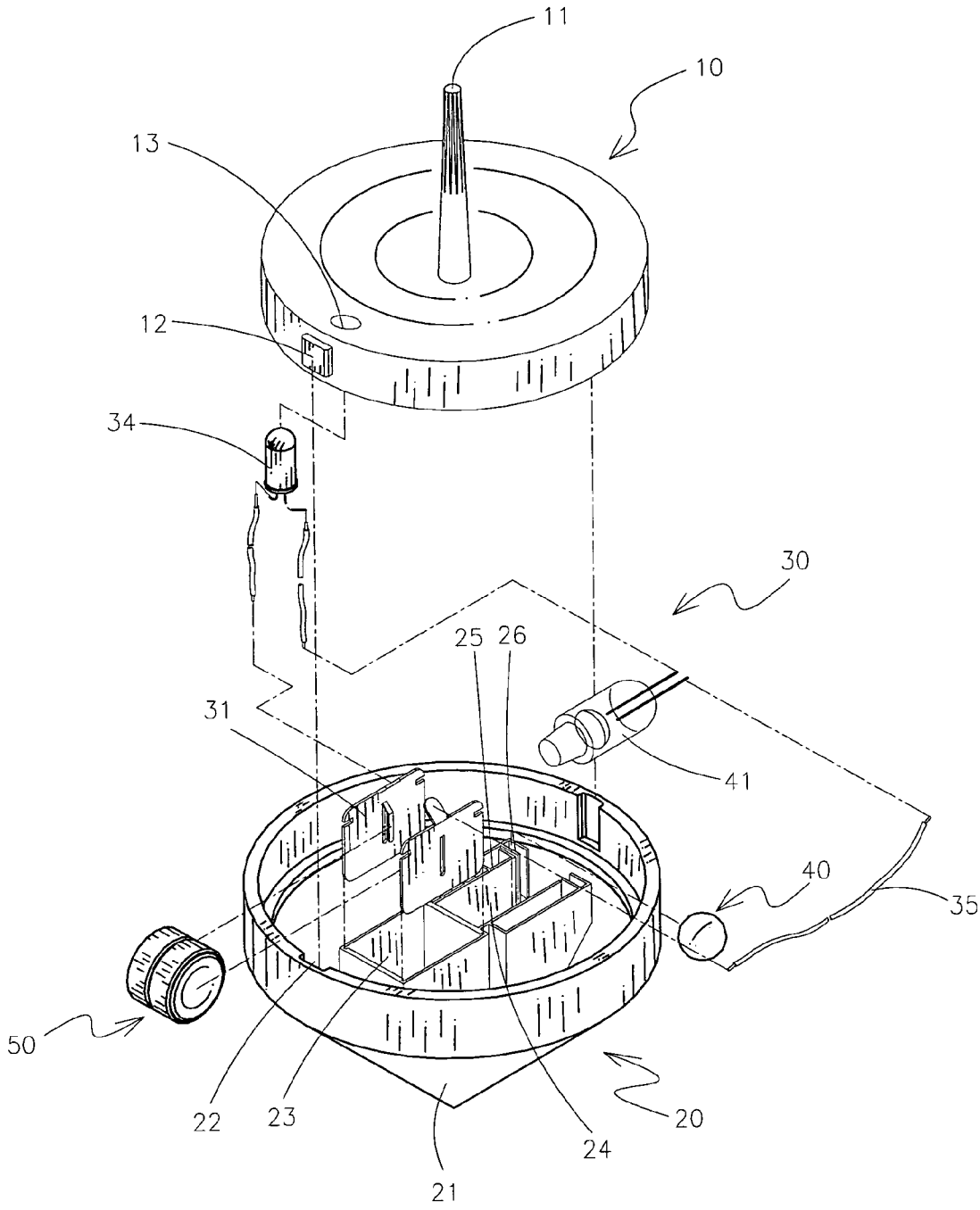
FIG. 6 is an exploded perspective view of the second embodiment of the top in accordance with the present invention.
Figure 7:
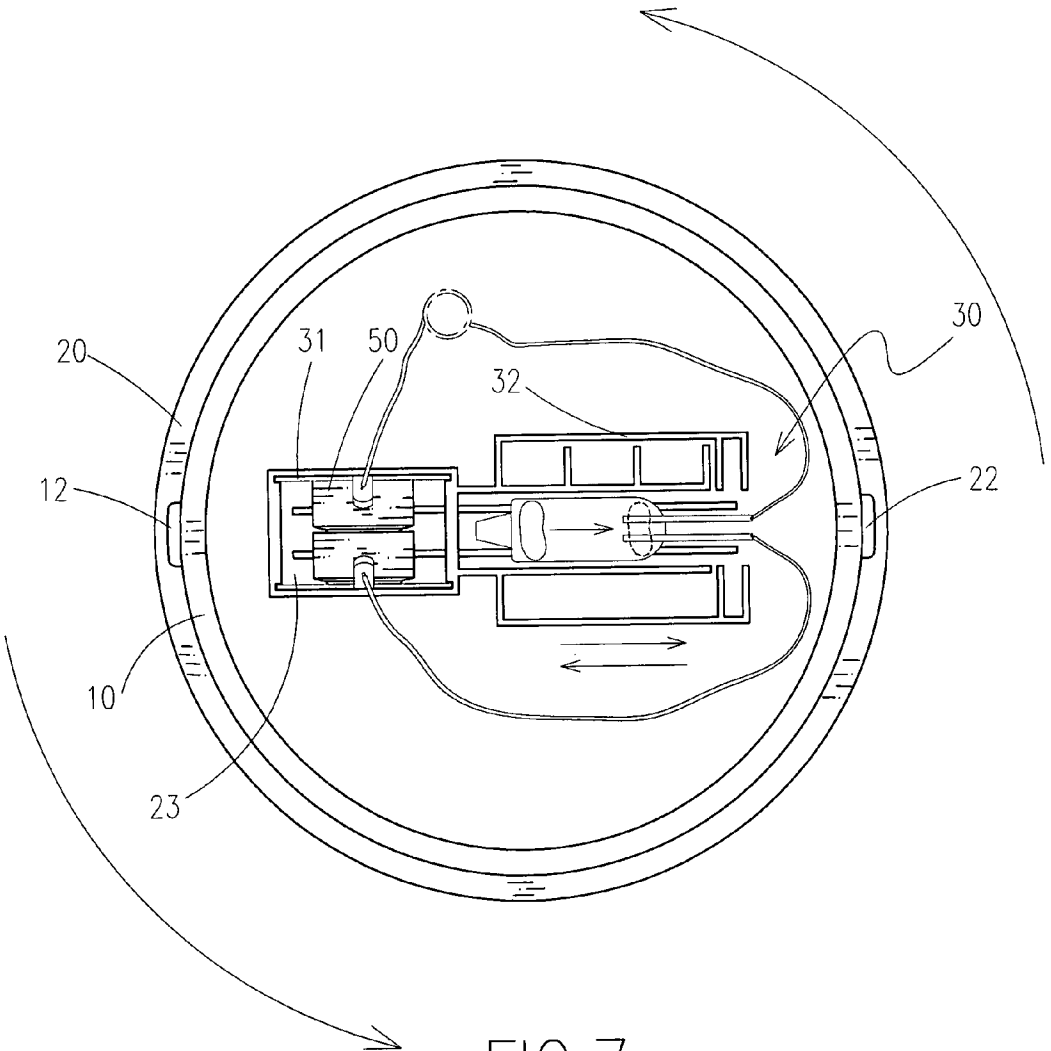
FIG. 7 is a cross-sectional view of the second embodiment of the top in accordance with the present invention.

With reference to FIGS. 6 and 7, the conductor (41) can be exchanged for a switch (41) that is a mercury switch. In addition, the battery (50) is a mercury battery.

As described above, the top with a lighting device in accordance with the present invention comprises the following advantages.

1. The lighting element (34) of the lighting device (30) lights and forms a ring of light that promotes the amusing effect of a top when the top is rotated.

2. The lighting element (34) of the lighting device (30) only lights when the top is rotated. Consequently, the top of the present invention can encourage the curious desire of a child who plays the top in accordance with the present invention.

Although the invention has been explained in relation to its preferred embodiment, it is to be understood that many other possible modifications and variations can be made without departing from the spirit and scope of the invention as hereinafter claimed.

What is claimed is:

1. A top with a lighting device, comprising:

a hollow body including tapered portion formed on a lower portion thereof, a first trough disposed in the hollow body for receiving a battery and a second trough disposed in the hollow body for receiving a conductor, a passage disposed in the hollow body and adjacent to one side of the second trough and a pair of guiding slots disposed on one end of the second trough opposite to the first trough;

the lighting device including two first conducting plates respectively secured on two opposite walls of the first trough for clamping the battery, an L-shaped second conducting plate mounted in the hollow body and having one end received in the passage, a third conducting plate having two opposite sides respectively received in the pair of slots and a lighting element mounted in the hollow body; and a cover mounted to a top of the hollow body for closing the hollow body, the cover having a grip centrally upwardly extending therefrom for user to easily operate the top and a transparent portion formed therein and aligning with the lighting element of the lighting device;

whereby the conductor is moved toward the periphery of the hollow body along the second trough due to a centrifugal force of the rotating top for compressing the free end of the second conducting plate to contract with the third conducting plate to form an electric conduction.

2. The top as claimed in claim 1, wherein the lighting device comprises two wires respectively electrically connected to two electrodes of the lighting element, wherein one of the two wires is electrically connected to one of the two first conducting plates and the other is electrically connected to a free end of the second conducting plate, the other first conducting plate is electrically connected to the third conducting plate.

3. The top as claimed in claim 2, wherein each first conducting plate has a boss formed thereon for providing a stable connection between the two first conducting plates and the battery.

4. The top as claimed in claim 1, wherein the conductor is a steel ball.

5. The top as claimed in claim 1, wherein the conductor is metal cylinder.

6. The top as claimed in claim 1, wherein the conductor is made of nonmetal.

7. The top as claimed in claim 1, wherein the cover comprises multiple buckles outwardly extending therefrom the hollow body comprises multiple slots defined in an inner periphery of the hollow body, each slot receiving a corresponding one of the multiple buckle to hold the cover in place.

8. The top as claimed in claim 1, wherein the conductor is a switch that is a mercury switch.

9. The top as claimed in claim 1, wherein the battery is a mercury battery.

* * * * *